US005987278A

United States Patent [19]

Nomura et al.

[11] Patent Number: 5,987,278

[45] **Date of Patent: *Nov. 16, 1999**

[54] PROCESS CARTRIDGE AND IMAGE FORMING APPARATUS USABLE THEREWITH

[75] Inventors: Yoshiya Nomura, Tokyo; Tadayuki Tsuda, Kawasaki; Shinichi Sasaki, Fujisawa; Isao Ikemoto, Kawasaki; Kazushi Watanabe, Yokohama; Hiroyuki Shirai; Toshiyuki Karakama, both of Tokyo, all of Japan

[73] Assignee: Canon Kabushiki Kaisha, Tokyo, Japan

[ * ] Notice: This patent is subject to a terminal disclaimer.

[21] Appl. No.: 08/943,692

[22] Filed: Oct. 3, 1997

Related U.S. Application Data

[63] Continuation of application No. 08/770,687, Dec. 17, 1996, abandoned, which is a continuation of application No. 08/478,660, Jun. 7, 1995, abandoned, which is a continuation of application No. 08/170,908, Dec. 21, 1993, abandoned, which is a continuation of application No. 08/068,287, May 28, 1993, Pat. No. 5,294,960, which is a continuation of application No. 07/785,401, Oct. 30, 1991, abandoned, which is a continuation-in-part of application No. 07/689,517, Apr. 23, 1991, Pat. No. 5,208,634.

[30] Foreign Application Priority Data

| | | | |
|---|---|---|---|
| Nov. 6, 1990 | [JP] | Japan | 2-301779 |
| Mar. 19, 1991 | [JP] | Japan | 3-054446 |

[51] Int. Cl.[6] ..... G03G 15/00; G03G 21/18

[52] U.S. Cl. ..... 399/109; 399/113

[58] Field of Search ..... 399/103, 106, 399/109, 111, 113; 29/402.01, 402.02, 402.03, 469

[56] References Cited

U.S. PATENT DOCUMENTS

| | | | |
|---|---|---|---|
| 4,386,838 | 6/1983 | Hirabayashi | 355/200 |
| 4,500,195 | 2/1985 | Hosono | 355/208 |
| 4,605,299 | 8/1986 | Mochimaru | 355/3 R |
| 4,708,455 | 11/1987 | Kubota et al. | 355/211 |
| 4,757,344 | 7/1988 | Idenawa et al. | 355/3 R |
| 4,816,877 | 3/1989 | Keen | 355/206 |
| 4,851,960 | 7/1989 | Nakamura et al. | 361/255 |
| 4,862,210 | 8/1989 | Woolley | 355/245 |

(List continued on next page.)

FOREIGN PATENT DOCUMENTS

| | | |
|---|---|---|
| 0276192 | 7/1988 | European Pat. Off. . |
| 0276910 | 8/1988 | European Pat. Off. . |
| 0368346 | 5/1989 | European Pat. Off. . |
| 0330225 | 8/1990 | European Pat. Off. . |
| 2611930 | 9/1988 | France . |
| 8716525 | 1/1988 | Germany . |
| 8907136 U | 5/1990 | Germany . |
| 4003695A1 | 8/1990 | Germany . |
| 58-21262 | 2/1983 | Japan . |
| 60-168159 | 8/1985 | Japan . |
| 2-123376 | 5/1990 | Japan . |
| 2-163769 | 6/1990 | Japan . |
| 2-168277 | 6/1990 | Japan . |
| 2-257146 | 10/1990 | Japan . |
| 2074095 | 10/1981 | United Kingdom . |

OTHER PUBLICATIONS

English Translation of Chinese Patent Application Search Report. European Search Report dated Jul. 8, 1994.

*Primary Examiner*—Joan Pendegrass

*Attorney, Agent, or Firm*—Fitzpatrick, Cella, Harper & Scinto

[57] ABSTRACT

A process cartridge detachably mountable to a main assembly of an image forming apparatus, the cartridge comprising a photosensitive member, a developing means for developing a latent image formed on the photosensitive member, a first frame containing the developing means; and a second frame coupled with the first frame, the second frame including a developer containing portion for containing a developer to be supplied to the developing means to develop the latent image, wherein the second frame is a selected one of plural secondary frames engageable with the first frame and having different developer containing capacities.

30 Claims, 15 Drawing Sheets

U.S. PATENT DOCUMENTS

| | | | |
|---|---|---|---|
| 4,862,212 | 8/1989 | Tanzawa et al. | 355/245 |
| 4,866,482 | 9/1989 | Hirasawa et al. | 355/260 |
| 4,924,267 | 5/1990 | Yoshikawa et al. | 355/21 |
| 4,930,684 | 6/1990 | Patterson | 222/325 |
| 4,974,020 | 11/1990 | Takamatsu et al. | 355/208 |
| 4,974,023 | 11/1990 | Aimoto et al. | 355/208 |
| 4,987,446 | 1/1991 | Mochimaru et al. | 355/200 |
| 4,996,566 | 2/1991 | Morita et al. | 355/246 |
| 5,036,358 | 7/1991 | Yoshida | 355/203 |
| 5,051,778 | 9/1991 | Watanabe et al. | 361/200 |
| 5,080,745 | 1/1992 | Paull | 156/247 |
| 5,110,646 | 5/1992 | Prestel et al. | 428/43 |
| 5,115,272 | 5/1992 | Ohmori et al. | 355/200 |
| 5,160,963 | 11/1992 | Haneda et al. | 355/200 |
| 5,184,182 | 2/1993 | Michlin | 355/260 |
| 5,223,068 | 6/1993 | Baley | 156/94 |
| 5,267,003 | 11/1993 | Grappiolo | 355/260 |
| 5,272,505 | 12/1993 | Shishido et al. | 355/219 |
| 5,294,960 | 3/1994 | Nomrua et al. | 355/210 |
| 5,296,902 | 3/1994 | Michlin | 355/260 |

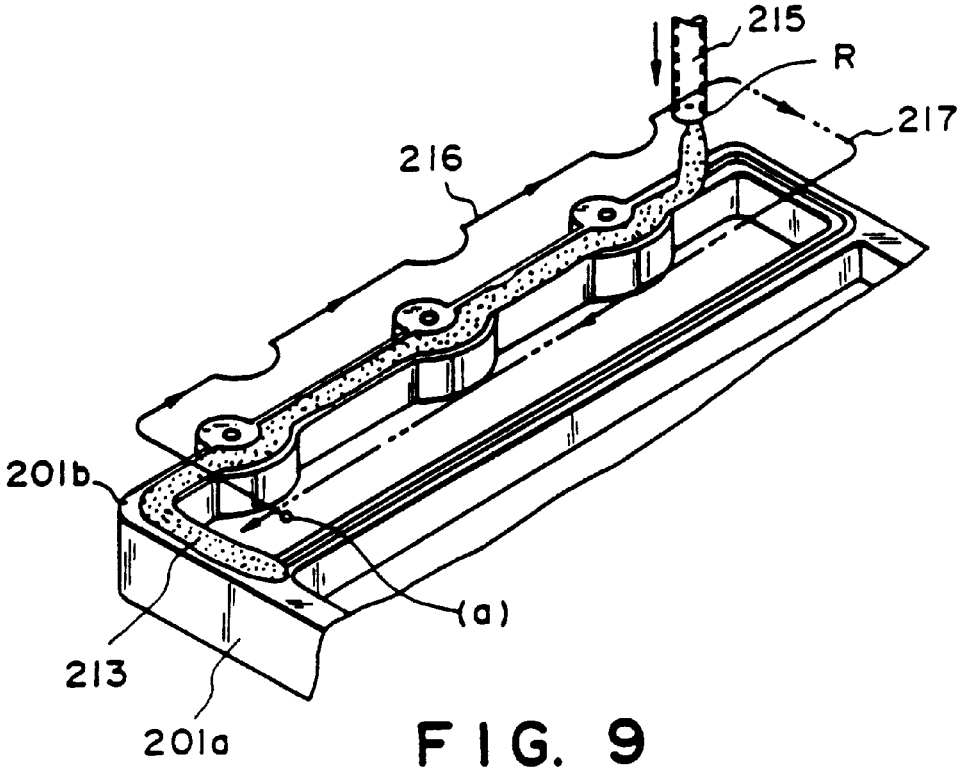
FIG. 9
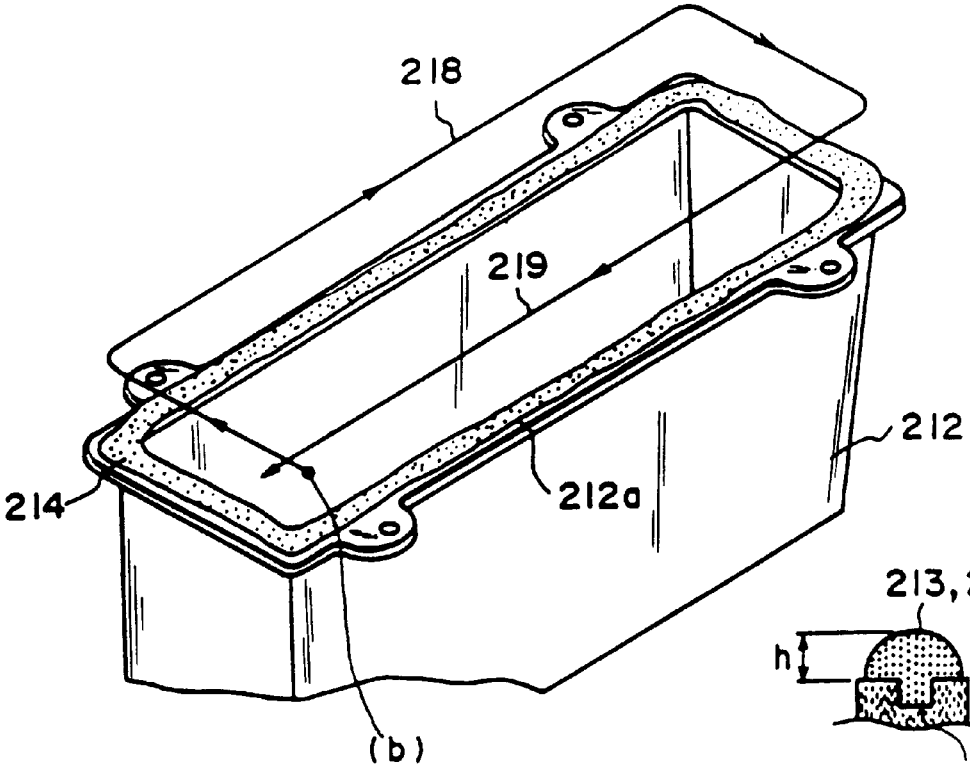
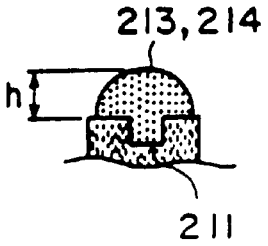
FIG. 10 FIG. 11

PROCESS CARTRIDGE AND IMAGE FORMING APPARATUS USABLE THEREWITH

This application is a continuation of application Ser. No. 08/478,660 filed Jun. 7, 1995 now abandoned, which is a continuation of application Ser. No. 08/170,908 filed Dec. 21, 1993 now abandoned, which is a continuation of 08/068,287 filed May 28, 1993, now U.S. Pat. No. 5,294,960; which is a continuation of Ser. No. 07/785,401 filed Oct. 30, 1991 now abandoned; which is a continuation-in-part of Ser. No. 07/689,517 filed Apr. 23, 1991, now U.S. Pat. No. 5,208,634.

FIELD OF THE INVENTION AND RELATED ART

The present invention relates to a process cartridge and an image forming apparatus to which the process cartridge is detachably mountable. The image forming apparatus may be in the form of an electrophotographic machine, electrostatic recording machine such as a copying machine or a laser beam printer.

Image forming machines such as copying machine require maintenance and servicing operations after they are operated for a long period of time, including replacement of an image bearing member (photosensitive drum), replacement of the developing device or replenishment of the developer (toner), cleaning of a discharging wire of a charging device, replacement of a cleaning device filled with residual toner and adjustment or replacement of some elements around the photosensitive drum.

However, the maintenance and servicing operations require expert knowledge and skill, and therefore, have not been easy for ordinary users.

In consideration of the situation, a process cartridge structure has been proposed in which a process cartridge contains as a unit the photosensitive drum and process means such as a developing device, a charging device, the cleaning device or the like. The process cartridge as a unit is detachably mountable to a main assembly of the image forming apparatus. If the maintenance or servicing operations are necessary in the process means, the entire process cartridge is replaced with a fresh cartridge so that the necessity for the maintenance and servicing operations are eliminated.

Referring first to FIG. 17, there is shown a structure of such a process cartridge. It comprises a photosensitive drum 10, and a cleaning device 13 and a developing device 11 which sandwich the photosensitive drum 10. Substantially above the developing device 11, there is a toner container 110 which is coupled with the developing device 11. Substantially above the photosensitive drum 10, there is a charging device 12. The cleaning device 13 functions to remove the residual toner from the peripheral surface of the photosensitive drum 10 so as to prepare the photosensitive drum 10 for the next image forming operation. The cleaning device 13 comprises a cleaner container 13*a* for accommodating removed residual toner, a cleaning blade 131 for scraping the residual toner off the peripheral surface of the photosensitive drum 10, a toner receiving sheet 132 for receiving the toner scraped by the cleaning blade 131 and for directing it into the cleaner container 13*a*, and a stirring member (not shown) for conveying the toner received by the cleaner container 13*a* to the inside thereof.

The developing device 11 functions to supply the toner to the electrostatic latent image of the photosensitive drum 10 to visualize it. The developing device 11 comprises a developer container 11*a*, a developing sleeve 112 for supplying the toner to the peripheral surface of the photosensitive drum 10, a developing blade 11*b* in sliding contact with the developing sleeve 112 to triboelectrically charge the toner and to form on the developing sleeve 112 a toner layer having a constant thickness. A wall of the developer container 11*a* remote from the photosensitive drum 10 is provided with an opening 11*c* which communicates with an unshown opening of a toner container 110 for containing the toner, so that the developer container 11*a* and the toner container 110 communicate with each other.

When the toner in the toner container 110 is used up, the process cartridge has to be replaced. The service life of the process cartridge has to be changed in accordance with the types of the image forming apparatus with which the process cartridge is used. For example, in the case of a high speed copying machine, the number of produced copies in a month is large, and therefore, the frequency of the process cartridge replacements is high. Therefore, it is desirable that the process cartridge has a larger capacity toner container to increase the service life thereof. On the other hand, in the case of a small capacity copying machine, the number of copies produced in a month is small. In addition, the reduction of the weight and the size of the main assembly of the image forming apparatus is desired. To meet this desire, the size of the process cartridge is reduced with the reduction of the toner capacity. Thus, different process cartridges are to be prepared for different main assemblies of the image forming apparatus.

SUMMARY OF THE INVENTION

Accordingly, it is a principal object of the present invention to provide a process cartridge and an image forming apparatus usable therewith in which when a process cartridge is manufactured in a factory, the process cartridge may be easily assembled with a different service life.

It is another object of the present invention to provide a process cartridge and an image forming apparatus usable with the process cartridge in which the process cartridge can be easily assembled.

It is a further object of the present invention to provide a process cartridge and an image forming apparatus usable with the process cartridge in which the process cartridge is easily disassembled.

It is a further object of the present invention to provide a process cartridge and an image forming apparatus usable with the process cartridge in which the process cartridge can be easily assembled or disassembled, so that various parts are reusable, by which environmental contamination can be reduced.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 9 is a perspective view of the process cartridge when liquid elastomer is injected to a joint in a cartridge frame.

FIG. 10 is a perspective view of a cartridge after liquid elastomer is injected to the joint surface of the toner container.

FIG. 11 is a sectional view after the liquid elastomer is injected.

DETAILED DESCRIPTION OF THE PREFERRED EMBODIMENTS

Referring to the accompanying drawings, the embodiments of the present invention will be described.

Figure 3:
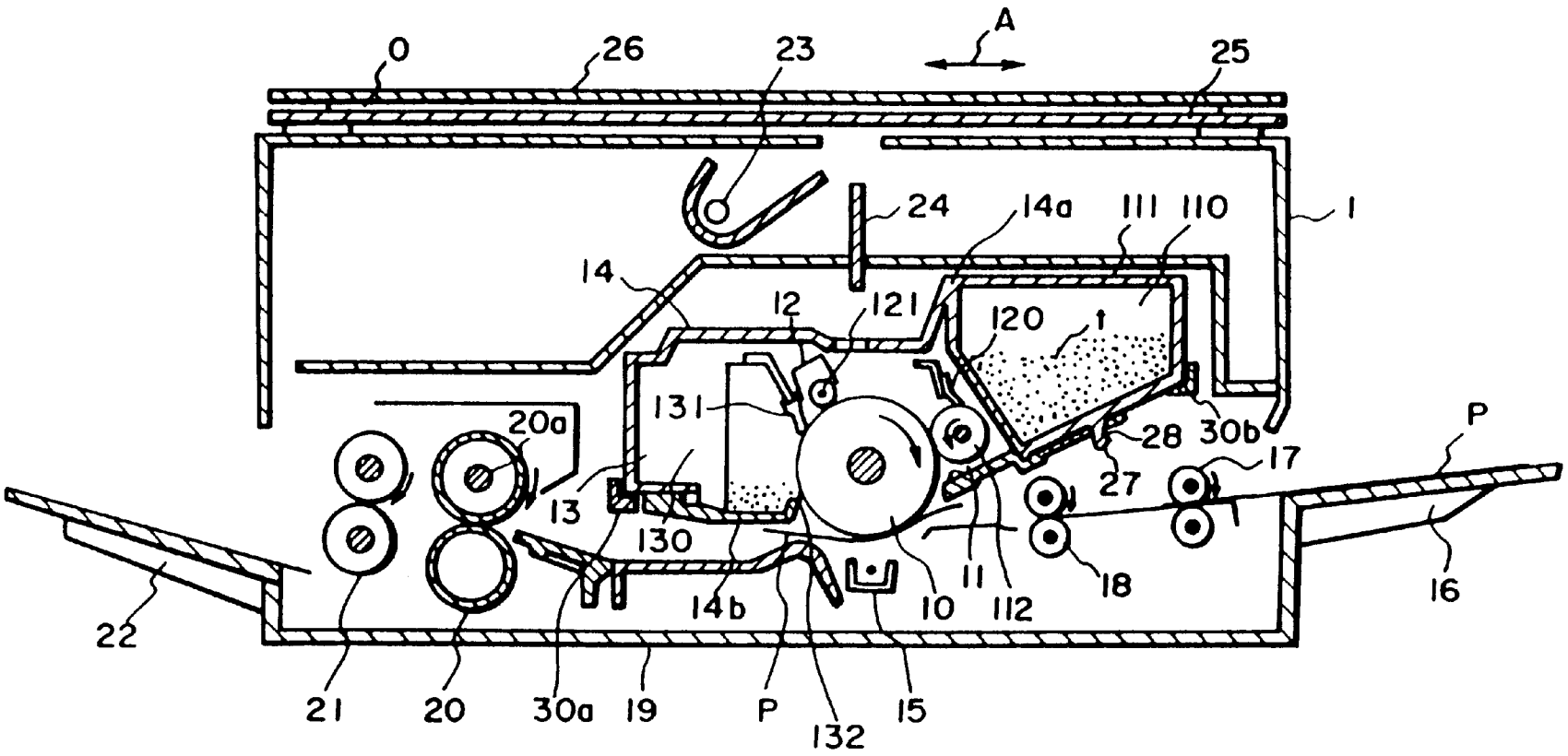
FIG. 3 is a sectional view of an image forming apparatus to which the process cartridge according to the present invention is detachably mountable.

Referring to FIG. 3, there is shown an image forming apparatus usable with a process cartridge according to an embodiment of the present invention. Designated by a reference numeral 10 is an image bearing member in the form of a photosensitive drum, for example. Around the photosensitive drum 10, there are disposed image formation process means such as a developing device 11, a charger 12 or a cleaning device 13. The photosensitive drum 10 and such process means are constituted into a unit on process cartridge frames 14*a* and 14*b* of plastic material. The process cartridge 14 thus constituted is detachably mountable to the main assembly 1 of the apparatus. Thus, the maintenance or servicing operation is made easier. The structure of the process cartridge casing will be described in detail hereinafter. When the process cartridge 14 is mounted in the main assembly, a transfer charger 15 is below the photosensitive drum 10. At the sheet supply side of the transfer charger 15, there are a sheet feeding tray 16, a pick-up roller 17 and registration rollers 18. On the other hand, at the sheet discharge side thereof, there are a sheet guide 19, an image fixing device 20, sheet discharging rollers 21 and a sheet discharge tray 22.

Above the process cartridge 14, there is disposed a short focus optical element array 24 for imaging on the photosensitive drum 10 the light which is emitted from an original illumination lamp 23 and is reflected by the original O. At the top of the main assembly 1, there is an original carriage 25 reciprocable in the directions A. Designated by a reference numeral 26 is an original cover.

The photosensitive drum 10 is uniformly charged by a charger and is exposed to the light from the original O through the optical element array 24, so that an electrostatic latent image is formed on the photosensitive drum 10 in accordance with the information of the original. The electrostatic latent image is carried by the rotation of the photosensitive drum 10 to the developing device 11 where the latent image is developed with toner t into a toner image. Then, the transfer sheet P is fed to the registration rollers 18 from the sheet tray 16 through the sheet feeding roller 17. Then, it is fed to between the photosensitive drum 10 and the transfer charger 15 in timed relation with the latent image by the registration roller 18. The toner image is transferred from the photosensitive drum 10 onto the transfer sheet P by the transfer charger 15. The transfer sheet P carrying the transferred toner image is fed to the fixing device 20 where the toner image is fixed into a permanent image. Then, the transfer sheet P is discharged onto the tray 22 by the discharging rollers 21. The photosensitive drum 10, after the completion of the image transfer, is cleaned by the cleaning device 13 for removing the residual toner, so that the photosensitive drum 1 is now prepared for the next image forming operation. Designated by reference numerals 30*a* and 30*b* are mounting means in the form of guides for facilitating mounting of the process cartridge 14 to the main assembly of the image forming apparatus.

Referring to FIGS. 1, 2A, 2B and 2C, the process cartridge 14 of this embodiment will be described in detail. The casing of the process cartridge 14 in this embodiment comprises upper casing A (14*a*) and a lower casing B (14*b*). The casings A and B can be joined to or disjoined from each other.

Figure 1:
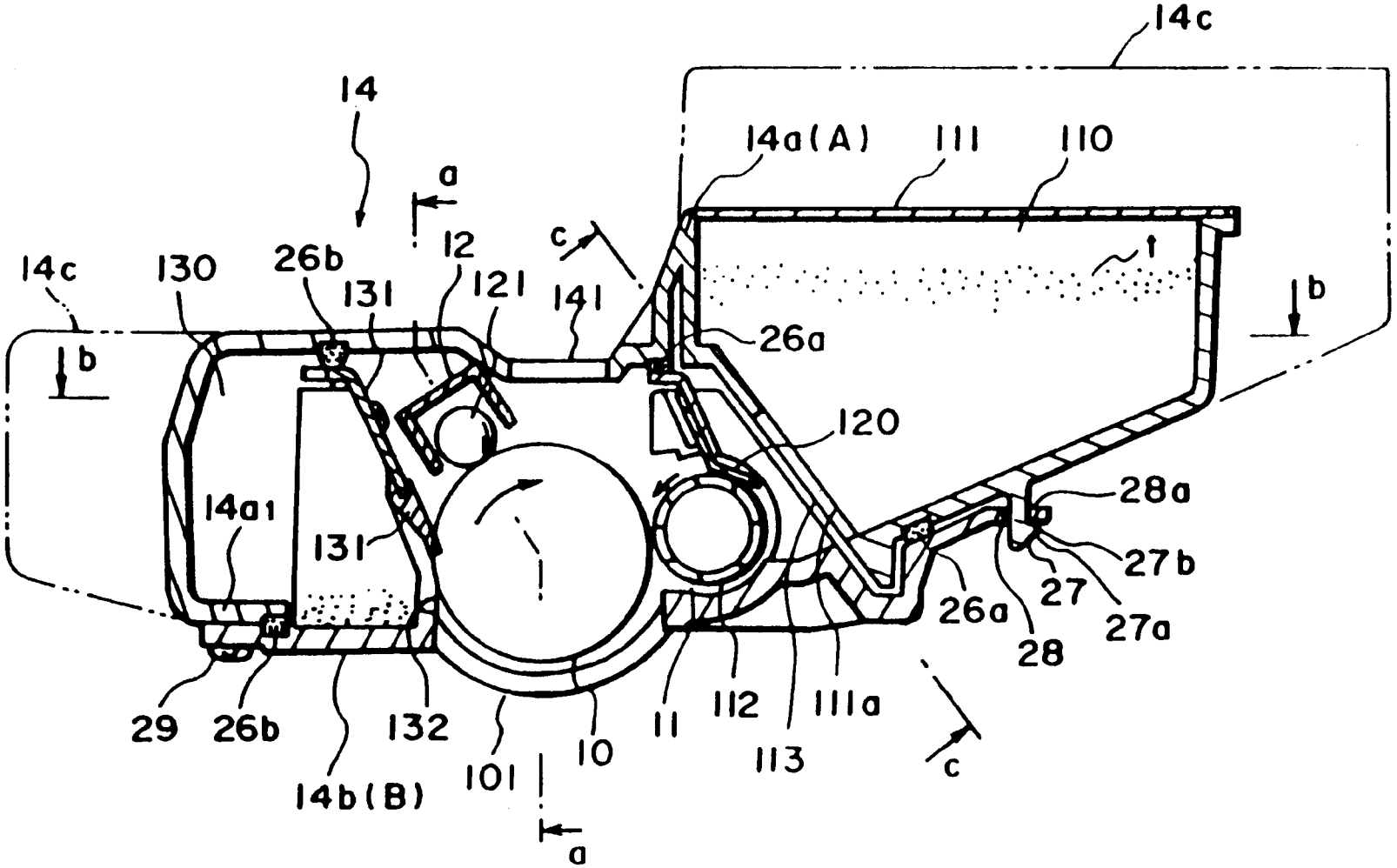
FIG. 1 is a sectional view of a process cartridge according to an embodiment of the present invention.

The casings A and B are of molded plastic material having elasticity. At the right side of the casing A, a toner container 110 functioning as the developer container is integrally formed. A plug 111 is fused to seal the container. The opening 111*a* of the toner container 110 which communicates with the developing device 11 is closed by a bonded sealing member 113, as shown in FIG. 2C. An end of the sealing member 113 is folded and is projected to the outside of the casing A. A grip 114 is connected to the end. When the operator pulls the grip 114, the sealing member 113 is removed from the opening 111*a* so as to permit supply of the toner t to the developing sleeve 112. Below the toner container 110, there is a pawl 27 for coupling the casings A and B. By the engagement between the pawl 27 integrally formed on the casing A and an opening formed in the casing B, the upper and lower casings A and B can be coupled with a simple structure. Four of such pawls 24 and corresponding openings 28 are arranged in a direction perpendicular to the sheet of the drawing. More particularly, the opening 28 is engaged by the pawl 27 at the inclined surface 27*a*, and an end 28*a* of the opening 28 is locked by the bottom surface 27*b* of the pawl 27. Since the pawl 27 has such an elasticity that the engagement with the opening 28 and the disengagement therefrom can be smoothly carried out and that the coupling by the opening 28 is assured. At the left side of the casing A, as shown in FIG. 1, a residual toner container (developer container) 130 is formed. An end of the casing A is folded to form a part 14*a*1 of the bottom surface of the container 130. The bottom casing B is extended to the position overlapping with the bottom surface 14*a*1, where they are threaded at the overlapped portion by screws 29. Therefore, the bottom surface of the container 130 is constituted by the parts of the casings A and B. A part of the casing A faced to the upper part of the photosensitive drum 10, is provided with an opening 141 for permitting passage of light for the image exposure. Around the openings in the toner container and the cleaner container, there are sealing members 26*a* and 26*b* made of foamed polyurethane material to prevent leakage of the toner from the container.

Figure 2A:
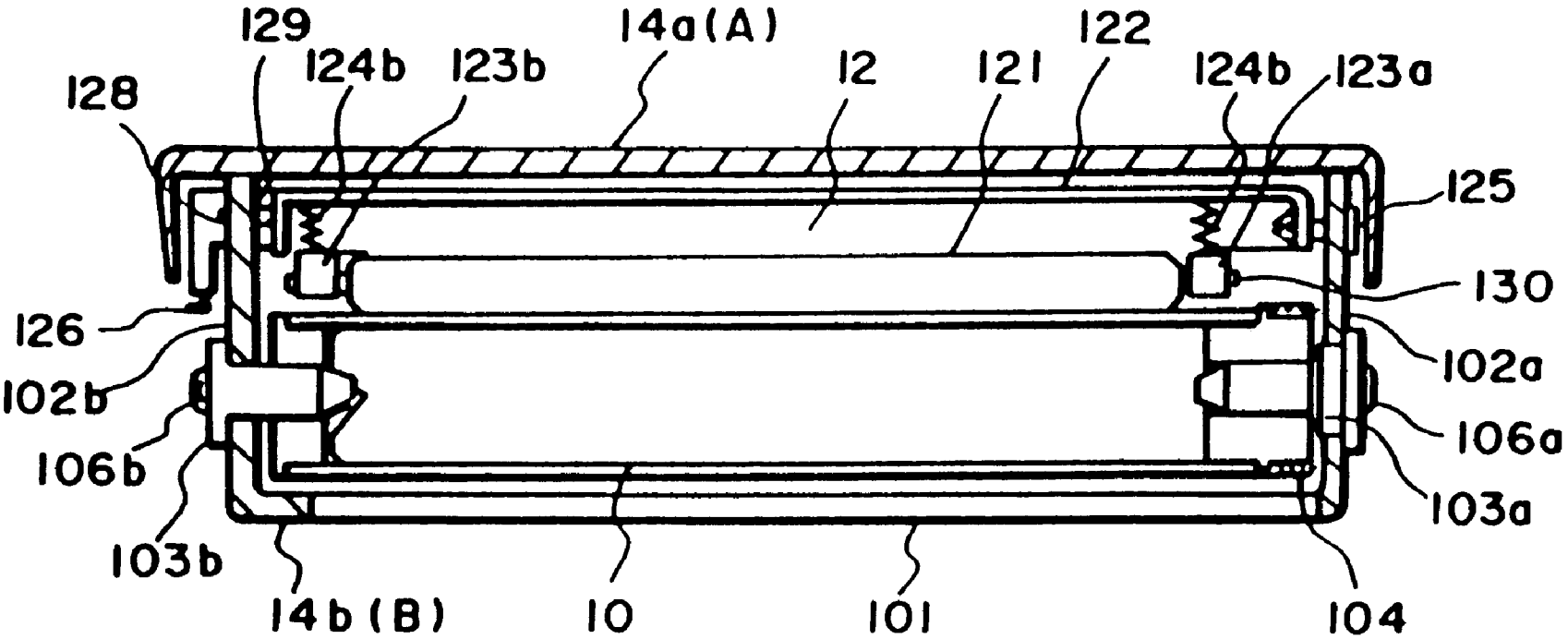
FIGS. 2A, 2B and 2C are sectional views taken along lines a—a, b—b and c—c, respectively, of FIG. 1.

As shown in FIG. 2A, the casing B covers the bottom part of the process cartridge 14, and from the side surface, walls 102*a* and 102*b* are raised and are extended to the bottom surface of the casing A. To the walls 102*a* and 102*b* of the casing B, supporting shafts 103*a* and 103*b* for rotatably supporting the photosensitive drum 10 are securedly mounted by screws 106*a* and 106*b* below the photosensitive drum 10, the casing B is provided with an opening 101 for permitting transfer of the toner image from the photosensitive drum 10 to the transfer sheet P and for receiving an unshown driving device of the main assembly of the image forming apparatus. Above the side wall 102*a* of the casing B, a charger case 122 is supported by a fixing pin 125. At the other end of the charger casing 122, a pin 128 is integrally formed and is engaged in and supported by a hole 129 formed in the side wall 102*b* of the casing B. In the charger casing 122, bearings 123*a* and 123*b*, which support a shaft 130 of the charging roller 121 while urging the charging roller 121 to the photosensitive drum 10. An end of the charger case 122 extends to the outside of the casing B and contains electrode plate 126 for supplying electric power to the charging roller 121. The electrode plates 126 are connectable with power supply contacts (not shown) of the main assembly of the image forming apparatus.

Figure 2B:
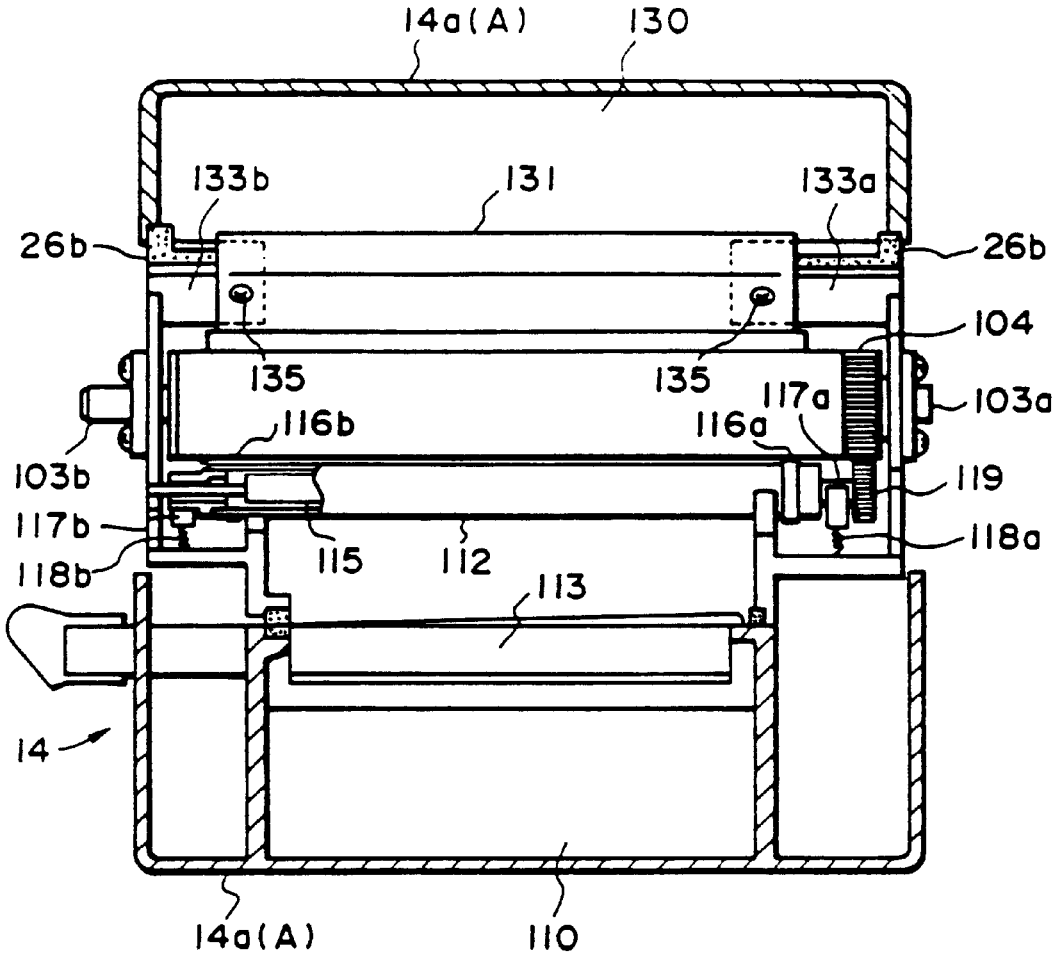
Figure 2C:
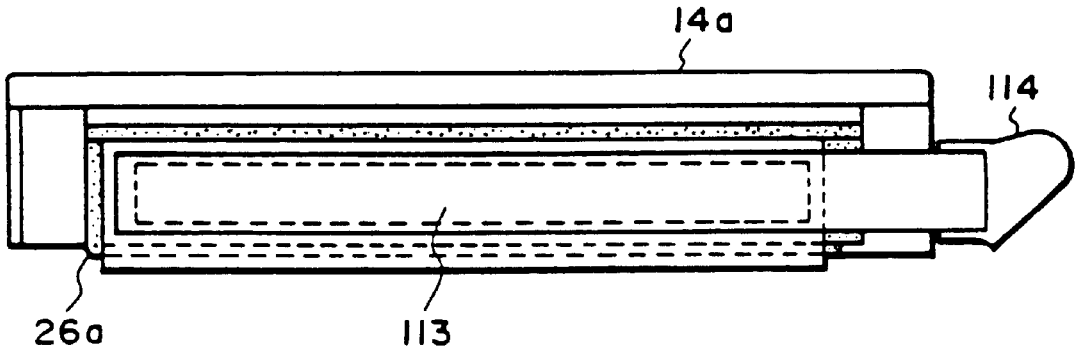

Referring to FIGS. 1 and 2B, the cleaning device 13 and the developing device 12 will be described in detail. The casing B is provided with seats 133*a* and 133*b* for mounting the cleaning blade 131 for contacting to the photosensitive drum 10 to scrape the residual toner off the peripheral surface of the photosensitive drum 10. The cleaning blade 131 is fixedly mounted on the seats 133*a* and 133*b* by screws 135. Adjacent a longitudinal end of the opening 101 formed at the lower side of the casing B, a receiving sheet 132 is bonded. The side wall of the casing B is bent toward inside adjacent the toner container 110. The bent portion functions to support through springs 118*a* and 118*b* sleeve bearings 117*a* and 117*b* for supporting the developing sleeve 112. The developing sleeve 112 has spacers 116*a* and 116*b* for maintaining a constant clearance between the surface of the developing sleeve 112 and the photosensitive drum 10. The spacers 116*a* and 116*b* are urged to the photosensitive drum by the springs 118*a* and 118*b*. To one of the ends of the developing sleeve 112, a gear 119 is mounted which meshes with a drum gear 104 mounted to the drum 10. With the rotation of the photosensitive drum 10, the gear 119, and therefore, the developing sleeve 112 is rotated in the direction indicated by an arrow in FIG. 1. In the developing sleeve 112, a cylindrical magnet roller 115 is disposed. It is provided with plural magnetic poles. The end pins thereof are supported by the casing B. Above the developing sleeve 112, a blade 120 is mounted on an unshown seat projected from the side walls 102*a* and 102*b* of the casing B.

The lower casing B contains the photosensitive drum 10, the cleaning blade 131, the receiving sheet 132, the charger 12, the developing sleeve 112 and the blade 120 for the developing sleeve 112. Therefore, the positional accuracies of various elements relative to the photosensitive drum 10 are assured by the accuracy of the casing B, and therefore, correct positioning is made easier.

In addition, the process cartridge 14 of this embodiment can be disassembled into the upper casing A and the lower casing B. The process cartridges 14 from which the toner has been used up, are collected. The collected cartridge 14 is disassembled into the casings A and B. Then, the casing A is cleaned, and a fresh sealing member 113 is bonded. Toner cap 300 is removed from a filling opening 1102, and the toner is supplied through the opening 100. Thereafter, the opening 100 is plugged by the toner cap 300, again. In addition, worn parts and creeped rubber elements or the like which are not reusable, are replaced with new ones. Then, the casings are joined together. The process cartridge 14 is now distributed from the factory.

Casing B containing the process means may be joined with another casing 14*c* which has the shape as shown in FIG. 1 and which has a larger toner capacity and a larger residual toner capacity than those of the casing B. Then, another process cartridge having a longer service life and usable with a different type main assembly, can be easily manufactured.

Figure 4:
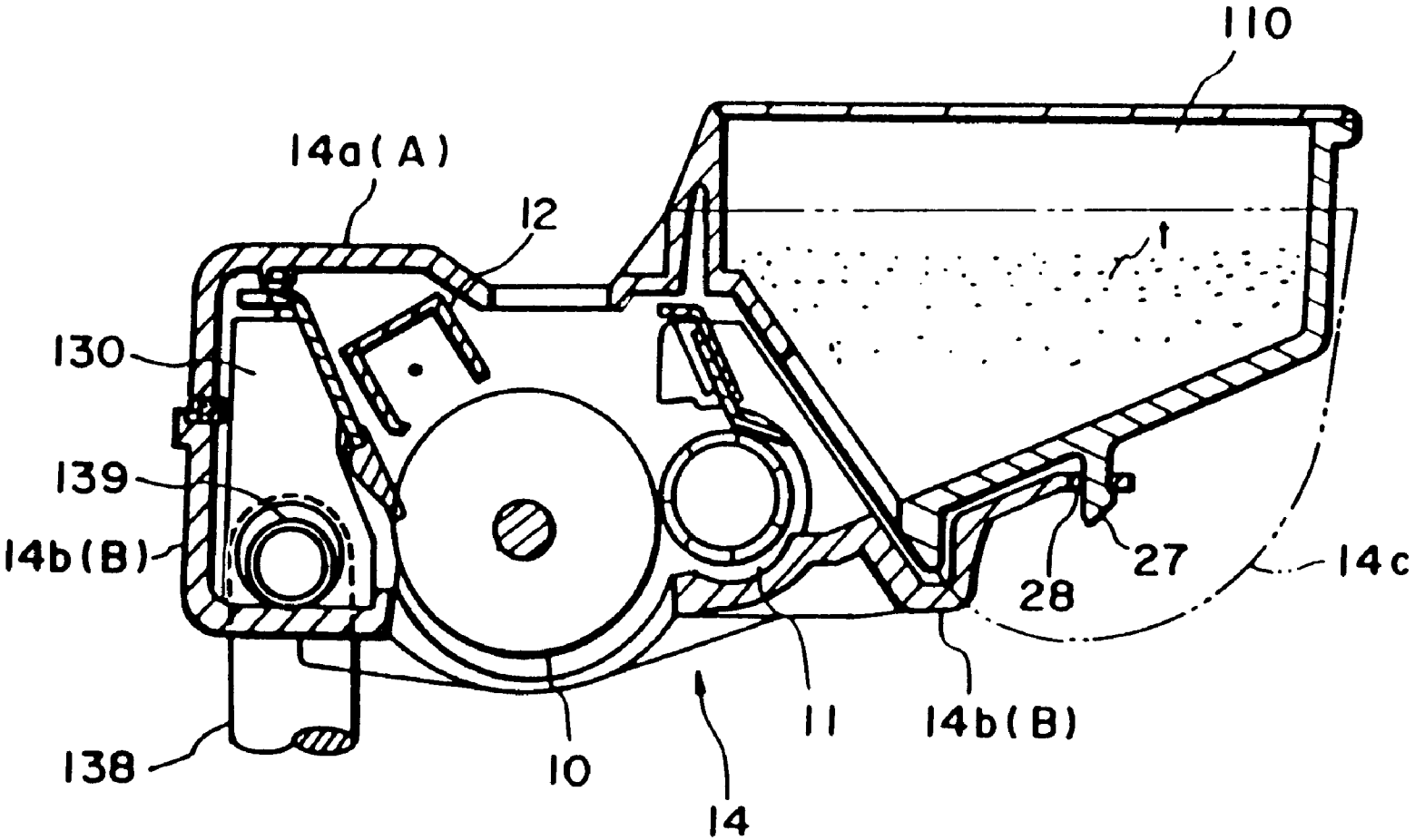
FIG. 4 is a sectional view of a process cartridge according to another embodiment of the present invention.

FIG. 4 shows a process cartridge according to another embodiment of the present invention. A pipe 138 is provided for permitting discharge of the residual toner from the process cartridge 14. The pipe is connected to an unshown residual toner bottle (not shown) in the main assembly of the image forming apparatus. The residual toner container is provided therein with a helical residual toner conveyer 139 for supplying the residual toner to the discharge pipe 138. An end of the residual toner conveyer 139 is coupled with a driving gear (not shown). The driving gear is meshed with the drum gear 104. In this example, it will suffice if the upper casing A is provided only with the toner container 110. The residual toner container is not necessary. Then, it is not necessary that the residual toner capacity is dependent on the toner capacity. In this embodiment, the residual toner container is formed by the coupling between the casing A and the casing B.

A phantom line 14*c* illustrates a configuration of another example of the casing A. In the case of the casing 14*c*, the toner container 110 is disposed at a lower side. The toner container 110 is provided therein with toner conveyer means (not shown). To both sides of the toner container 110, the casing B is extended and is engaged with coupling pawl 27 formed on the ends of the toner container 110 of the casing A.

In the foregoing embodiments, the process cartridge has the developing means. However, the present invention is applicable to the process cartridge not having the developing means. In this case, the present invention is applied to the residual toner container for the cleaning means.

Figure 5:
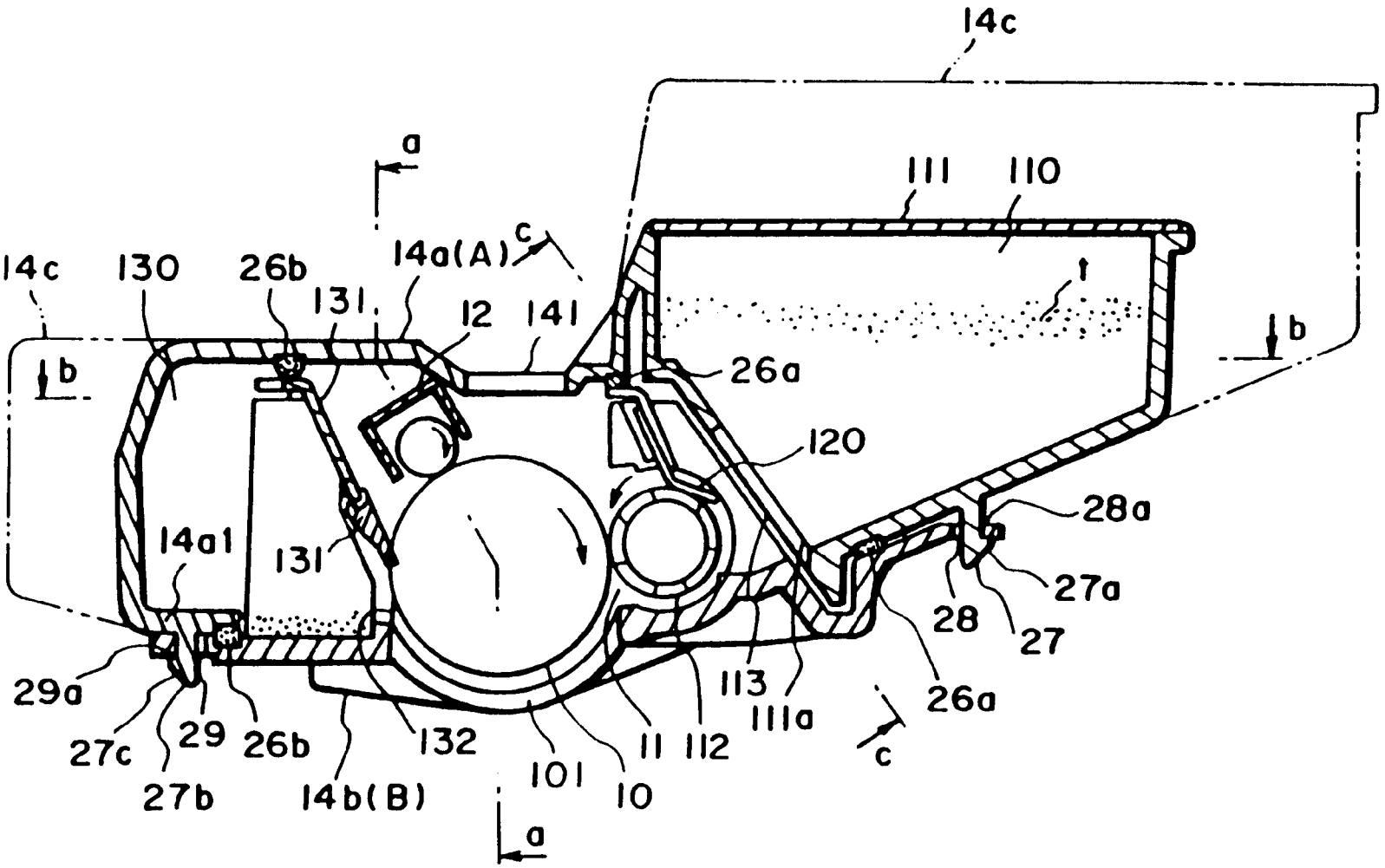
FIG. 5 is a sectional view of a process cartridge according to a further embodiment of the present invention.
Figure 6A:
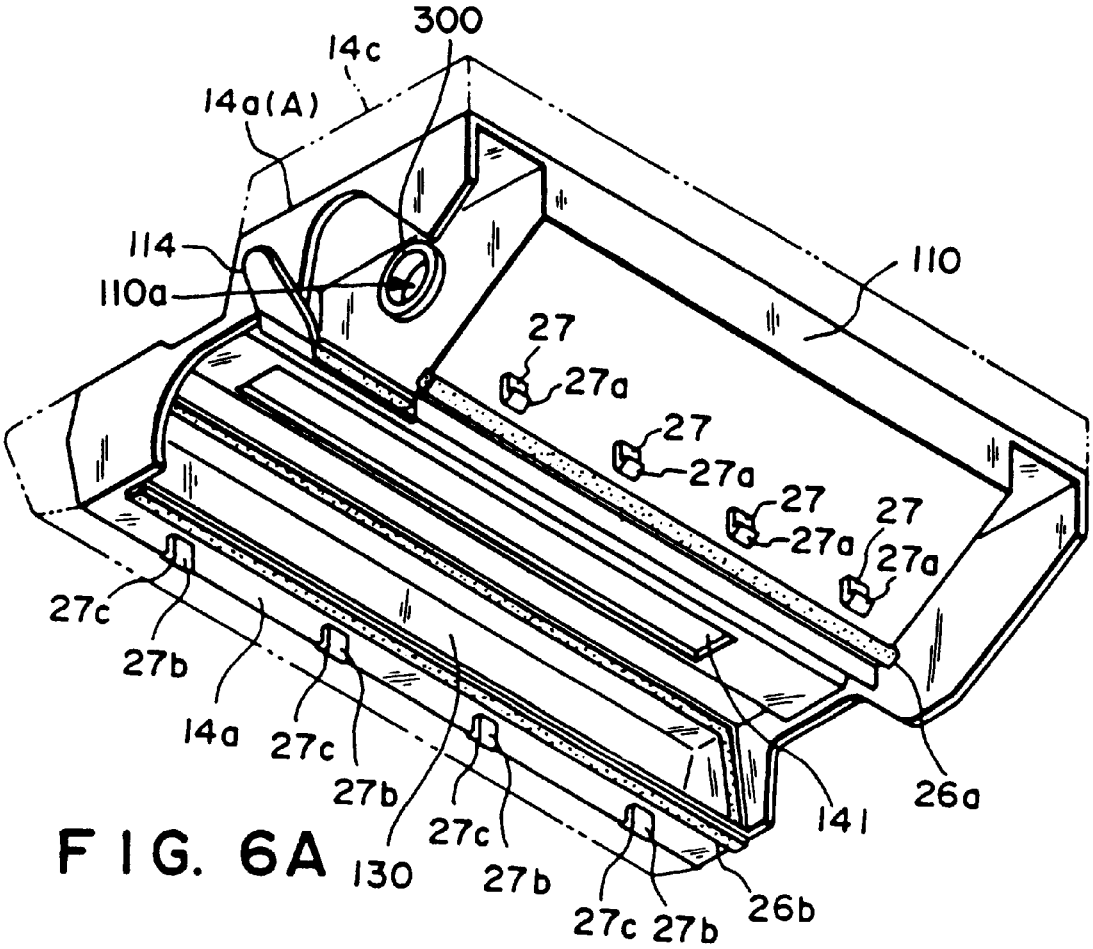
FIG. 6A is a perspective view of an upper body.
Figure 6B:
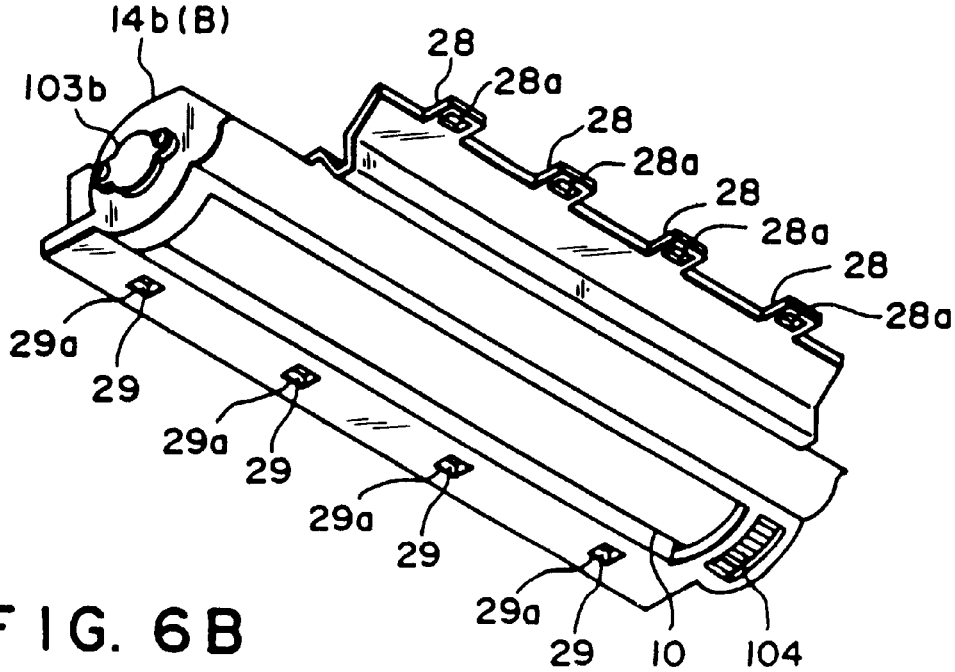
FIG. 6B is a perspective view of a bottom body.
Figure 7:
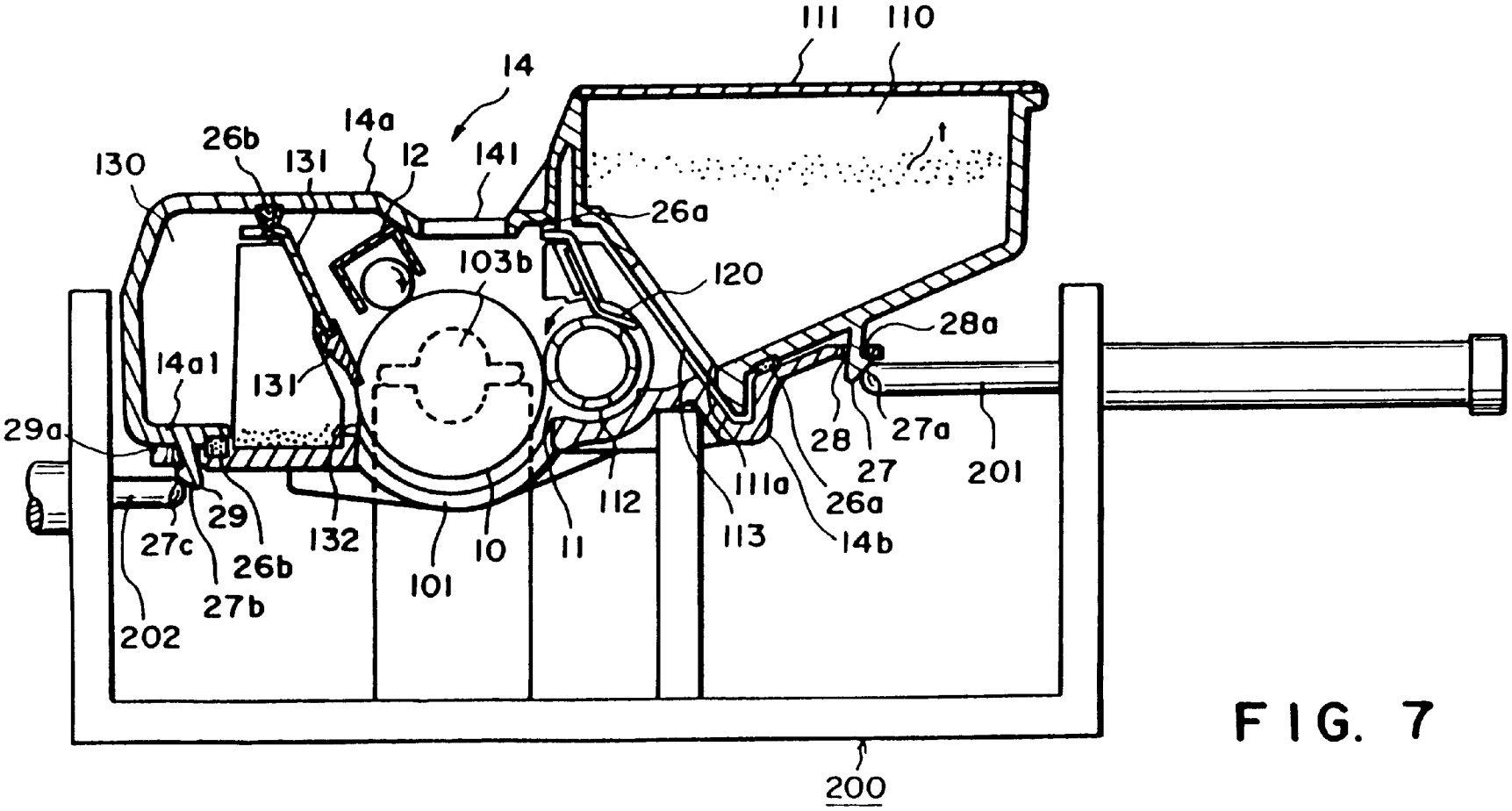
FIG. 7 illustrates disassembling of the process cartridge.

Referring to FIGS. 5, 6A and 6B, a further embodiment of the present invention will be described. FIG. 5 is a side sectional view of a process cartridge according to this embodiment, FIG. 6A is a perspective. view of an upper casing, and FIG. 6B is a perspective view of a lower casing.

In the foregoing embodiments, the upper and lower casings A and B are joined not only by the engagement between pawls and openings but also by screws. In the present embodiment, however, the casings A and B can be joined only by engagement between pawls and openings. In the description of this embodiment, the same reference numerals as in the foregoing embodiments are assigned to the elements having the corresponding functions, and the detailed description thereof are omitted for simplicity.

Sectional views taken along lines a—a, b—b and c—c in FIG. 5 are as shown in FIGS. 2A, 2B and 2C, respectively, which have been described hereinbefore. The process cartridge of this embodiment is also detachably mountable to the main assembly of the image forming apparatus, as shown in FIG. 3.

In this embodiment, the casing A and the casing B are securedly joined by engagement between pawls 27*b* and the openings 29 in place of the screws 29 in the above-described embodiment. In the present embodiment, four pawls 27*b* are formed on the bottom outside surface 14*a*1 of the residual toner container 130 formed at the left side of the casing A. Correspondingly, the casing B is provided with four openings 29 in the wall overlapped with the bottom surface 14*a*1 of the casing A. Similarly to the toner container 110 side, the pawls 27*b* of the casing A and the openings 29 of the casing B are engaged with each other at the residual toner container 130 side, so that the casings A and B are joined together. Designated by a reference 27*c* is an inclined surface of the pawl 27*b*, and 29 is an engaging end of the opening 29. In this embodiment, the pawls 27 at the toner container 110 side and the pawls 27*b* at the residual toner container 130 side are inclined outwardly, in other words, they are inclined away from each other. By doing so, the elasticity of the casings A and B of plastic material, more particularly, the elasticity of the pawls 27 and 20*b* cooperates to enhance the fastening engagement when they are engaged with the associated openings 28 and 29.

In this embodiment, the process cartridge can be easily disjoined. As described above, the upper and lower casings A and B are joined by the pawls 27 and 27*b*. When the process cartridge is to be disjoined, the process cartridge 14 is put on a disjoining device 200. Then, rods 201 and 202 are pushed to push the pawls 27 and 27*b*. Thus, the upper casing A can be easily disjoined from the lower casing B.

Without use of the device 200, the casings A and B can be disjoined from each other by properly pushing the pawls 27 and 27*b*. However, in this case, it is preferable to push the plural pawls simultaneously, and therefore, it is easier if the device 200 is used.

A further embodiment of the process cartridge will be described. In this embodiment, additional sealing members are employed to further prevent the leakage of the developer to the outside of the cartridge.

Figure 8:
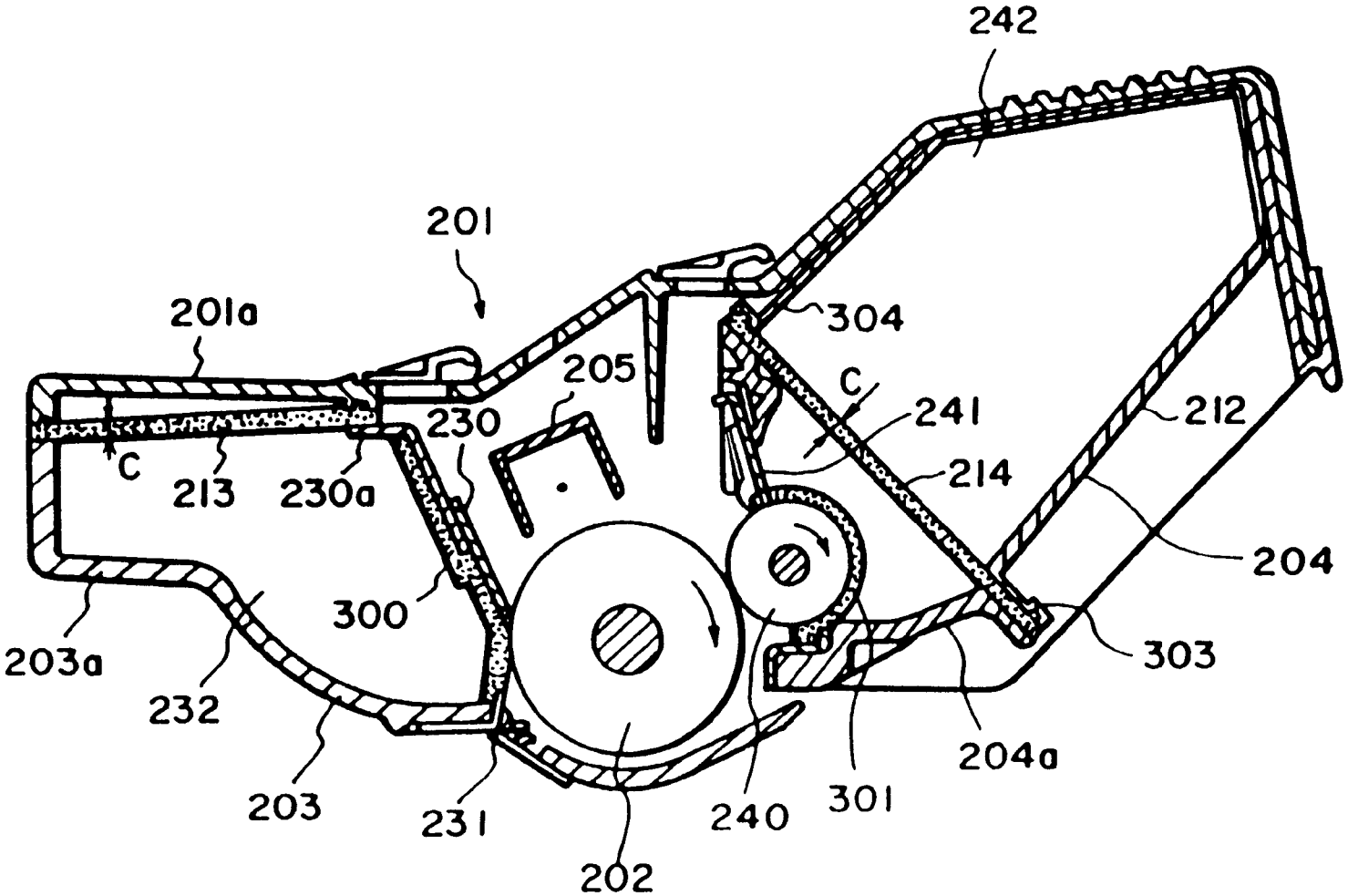
FIG. 8 is a sectional view of a process cartridge to which the present invention is applicable.

Referring to FIGS. 8, 9, 10 and 11, the description will be made as to the cartridge of this embodiment having the sealing members. FIG. 8 is a sectional view of the process cartridge according to this embodiment. The process cartridge 201 contains an image bearing member in the form of a photosensitive drum 202 and process means disposed therearound. the process means includes a cleaning device 203, a developing device 204 and a charger 205 supported on a cartridge frame 201*a*. They constitute a unit which is detachably mountable to a main assembly of the image forming apparatus, as a unit. When the photosensitive drum 202 and/or the developing device 204 comes to an end of the service life, when the cleaning device 203 is filled with the residual toner or when the toner in the developing device 204 is used up, the entirety of the process cartridge 201 is replaced with a new process cartridge. Thus, the maintenance or servicing operations are easy. In this embodiment, the charger 205 is in the form of a well-known corona charger, but it may be replaced with a contact type charger as disclosed in U.S. Pat. No. 4,851,960.

The cleaning device 203 comprises a cleaning blade 230 for removing the residual toner (residual developer): from the surface of the photosensitive drum 202, a toner receiving sheet 231 for preventing leakage of the residual toner to the outside, and a residual toner container 232 for containing the residual toner. The residual toner container 232 is constituted by connecting through sealing members 213 the cleaning container 203*a*, the blade holder 230*a* and the cartridge frame 201*a*. The sealing members 213 are effective to prevent leakage of the toner through the joint portions.

The developing device 204 comprises a developing sleeve 240 rotatable in a constant direction and effective to supply the toner (developer) from its outer periphery to the photosensitive drum 202, a regulating blade 241 for regulating a thickness of a layer of the developer on the developing sleeve 240, and a toner container 242 for containing the toner and for supplying the developer to the developing sleeve 240. The toner container 242 is constituted by the toner container 212 and the developer container 204 which are coupled by screws or the like with a sealing member 214 therebetween so that they can be disjoined and cleaned. The sealing member 214 is effective to prevent leakage of the toner through the joint portion.

In the process cartridge having the structure described above, the photosensitive drum 202 is uniformly charged by a charger 205 and is exposed to image light, so that an electrostatic latent image is formed on the photosensitive drum 202. With the rotation of the photosensitive drum 202, the electrostatic latent image reaches the developing device 204, where the latent image is supplied with the toner from the developing sleeve 240 of the developing device 204 so as to be developed into a toner image. The toner image is transferred onto the transfer sheet through an unshown transfer charger or the like. After the completion of the image transfer action, the photosensitive drum 202 is cleaned by the cleaning blade 230 so that the residual toner is removed from the photosensitive drum 202. Then, the photosensitive drum 202 is prepared for the next image forming operation. The residual toner removed by the cleaning blade 230 is collected into the residual toner container 232 of the cleaning device 203 by way of the receiving sheet 231 contacted to the photosensitive drum 202.

Referring to FIGS. 9 and 10, the description will be further made as to the sealing members 213 and 214. The sealing members of this embodiment are provided by injecting from a nozzle 215 two-liquid urethane rubber material R to a coupling surface 201*b* (FIG. 9) of the cartridge frame 201*a* and to a coupling surface 212*a* (FIG. 10) of the toner container 212. The material R is a foaming material, and therefore, it is foamed and solidified into elastomer on the coupling surfaces 201*b* and 212*a* approximately 20 sec.–10 min. after the injection.

In FIG. 9, the material R extends from point (a) along arrows 216 and 217 and returns to the point (a), thus constituting a closed loop. As regards the sealing member 214 shown in FIG. 10, the injection starts at point (b) and proceeds along the direction of arrows 218 and 219 and returns to the original point (b). The coupling surfaces 201*b* and 212*a* are provided beforehand with grooves 211 as shown in FIG. 11. Therefore, the material R ultimately becoming the sealing member flows into the groove and then is solidified into an elastic elastomer. Therefore, the sealing member is not easily removed or easily deviated.

With the solidified sealing members 213 and 214 on the cartridge frame 210*a* and the toner container 212, the cartridge frame 201*a* and the toner container 212 are coupled with the cleaning container 203*a* and the developing container 204*a*, respectively, by which the toner leakage through the connecting portions can be properly prevented. The height h (FIG. 11) of the elastomer members 213 and 214, after solidification, is larger than the clearance C (FIG. 8) after the containers are coupled, and therefore, the sealing members are pressed down to the height which is equal to the clearance C, thus filling the clearance.

In this embodiment, the material R injection or dispensing from the injection nozzle, the injection speed, and the injection rate, can be completely automatically controlled, so that the sealing members can be formed along the connecting surface with certainty. Therefore, the system conveniently meets the complicated shape as shown in FIG. 9.

In the foregoing description, the foaming polyurethane rubber is used as the sealing member material R. However, the material is not limited to this, and another material such as soft rubber or plastic material such as silicone rubber or another elastomer (elastic high polymer material) may be used with the same advantageous effects.

Thus, the sealing members are provided by solidifying liquid elastomer such as foaming polyurethane rubber or the like to seal the coupling portion of plural members such as the developing device 204 in the process cartridge, the toner container of the cleaning device 203 and the residual toner container. Therefore, the toner seal can be easily accomplished in the coupling portions of the containers having complicated structure. In addition, the closed loop can be easily formed, and therefore, the toner leakage through a sealing member connecting portion can be prevented.

Figure 12:
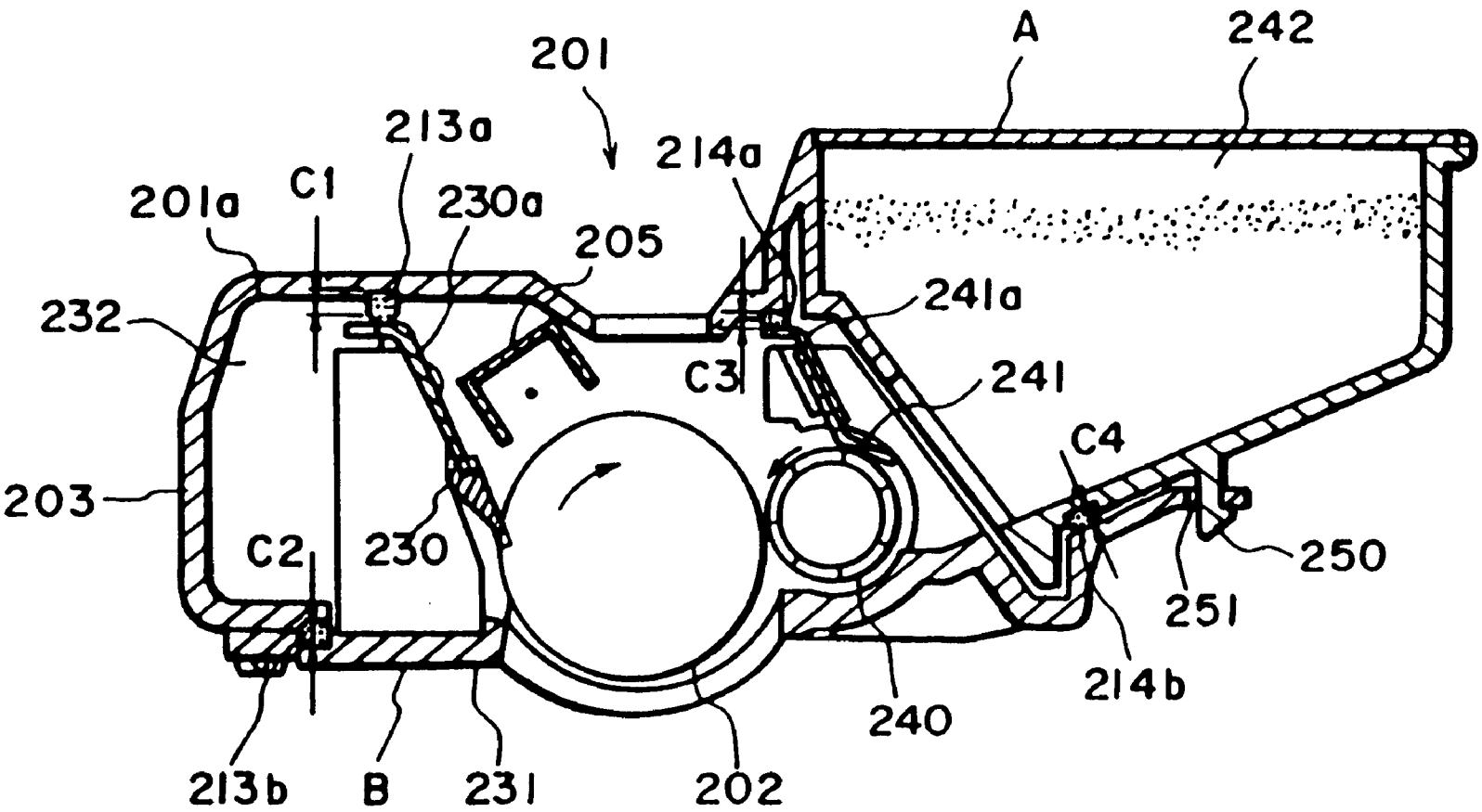
FIG. 12 is a sectional view of a process cartridge according to an embodiment of the present invention.
Figure 13:
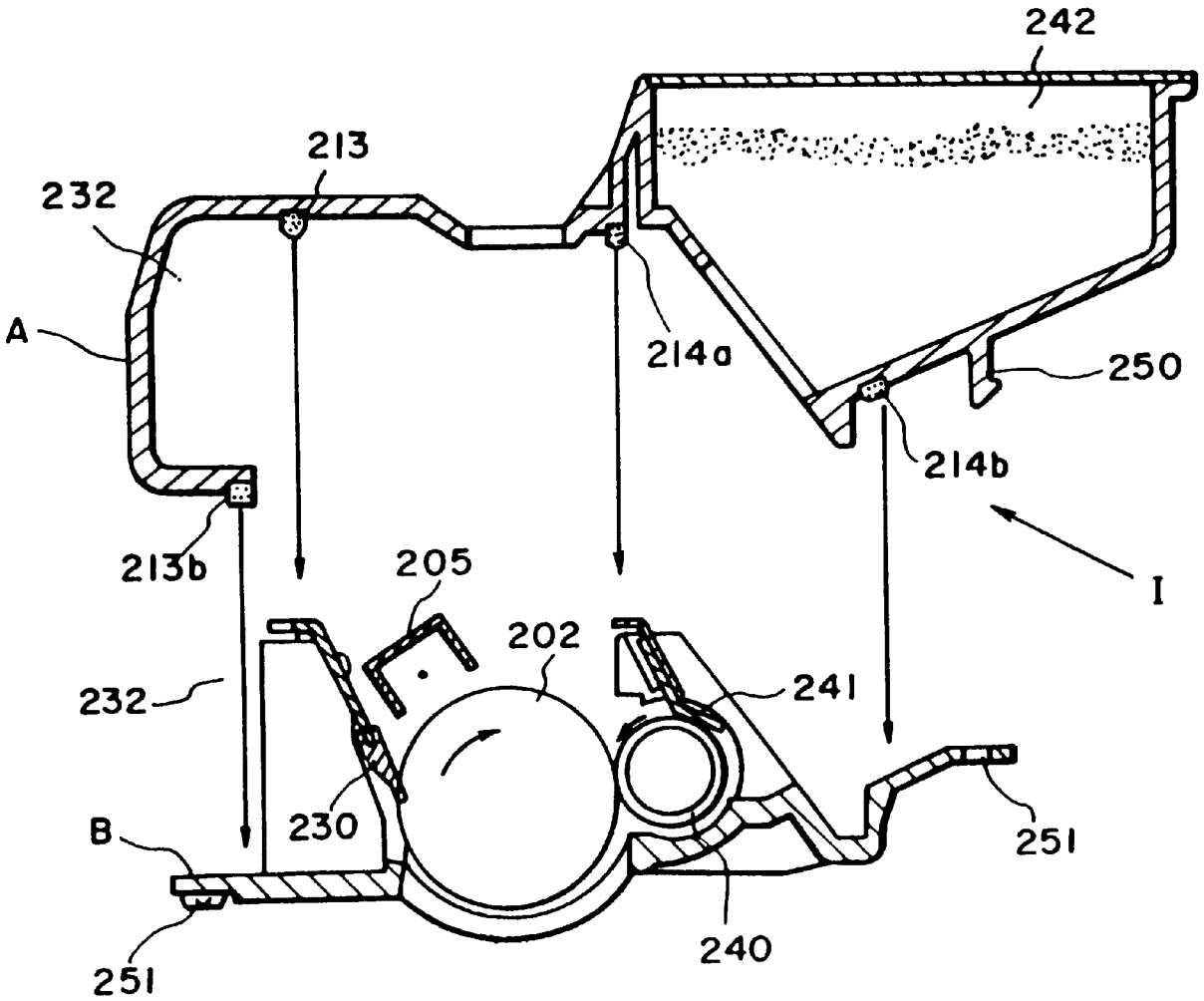
FIG. 13 is a sectional view when the process cartridge is divided into an upper body and a lower body.
Figure 14:
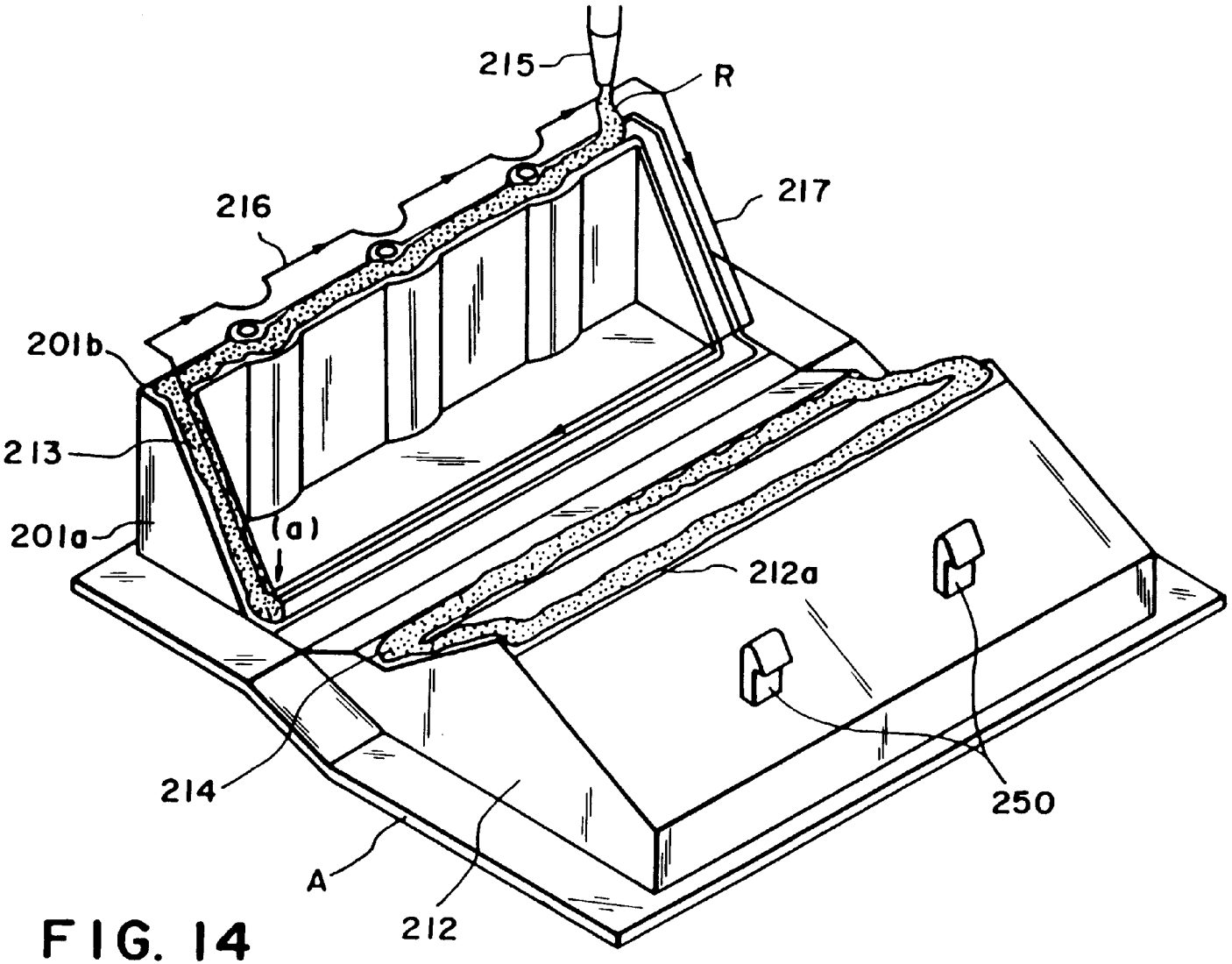
FIG. 14 is a perspective view when liquid elastomer is injected to the joint of the upper body.

Referring to FIGS. 12, 13 and 14, there is shown a process cartridge according to a further embodiment of the present invention. As shown in FIG. 12, the process cartridge is constituted by an upper frame A and a lower frame B. In this Figure, the same reference numerals as in FIG. 8 are added to the elements having the corresponding functions.

As shown in FIG. 13, the process cartridge of FIG. 12 has the upper and lower frames A and B which are coupled by pawls 250 and openings 251. The pawls 250 of the upper frame A are elastically engaged with associated openings 251 formed in the lower frame B, by which the upper frame A and the lower frame B are coupled. The upper and lower frames A and B sandwich sealing members 213*b* and 214*b*. The toner container 242 is constituted by coupling the upper and lower frames A and B and by coupling the upper frame A and a blade holder 241*a* for supporting a regulating blade 241. The coupling portions are provided with a sealing member 214*a* to prevent leakage of the toner. The residual toner container 232 of the cleaning device 203 is constituted by coupling the upper and lower frames A and B and by coupling the upper frame A and a cleaning holder 230*a* for supporting a cleaning blade 230. The coupling portion is provided with a sealing member 213*a* to prevent the toner leakage.

FIG. 14 shows the view in the direction I in FIG. 13. In this embodiment, as shown in FIG. 14, the two-liquid urethane rubber material R is dispensed from the nozzle 215 to the coupling surfaces between the upper and lower frame portions of the toner container and the residual toner container. Since the material is of foaming nature, it foams and becomes elastomer on the coupling surfaces 201*b* and 212*a* in approximately 30 sec.–10 min. after injection or dispense. The injection path starts at (a) and extends in the directions of arrows 216 and 217 to return the position (a), so that a closed loop is formed. The surfaces receiving the material R (coupling surfaces 201*b* and 212*a*) are formed into grooves beforehand, and therefore, the material R easily flows into the grooves, and then solidifies into an elastomer. Therefore, the sealing member is not easily removed or deviated. In this manner, with the solidified sealing members 213 and 214 on the upper frame A, it is coupled with the lower frame B, so that the sealing members 213 and 214 function to prevent leakage of the toner from the toner container and from the residual toner container. The height h (FIG. 11) of the sealing members 213 and 214, after solidification, is higher than the clearances C1, C2, C3 and C4 (FIG. 12) after the frames are coupled, and therefore, the elastomer is pressed to the heights equal to the clearances C1–C4, thus filling the clearances.

Similarly to the foregoing embodiment, in the present embodiment, the injecting path, speed and rate can be completely automatically controlled, so that the sealing member can be provided along the coupling surfaces with certainty. In addition, the injecting portions are concentrated on one of the frames, and therefore, the injecting or dispensing operation can be completed after only one positioning of the frames. This is advantageous in that the number of manufacturing steps can be significantly reduced.

Similarly to the foregoing embodiment, the material R may be soft rubber, soft plastic or the like.

Figure 15:
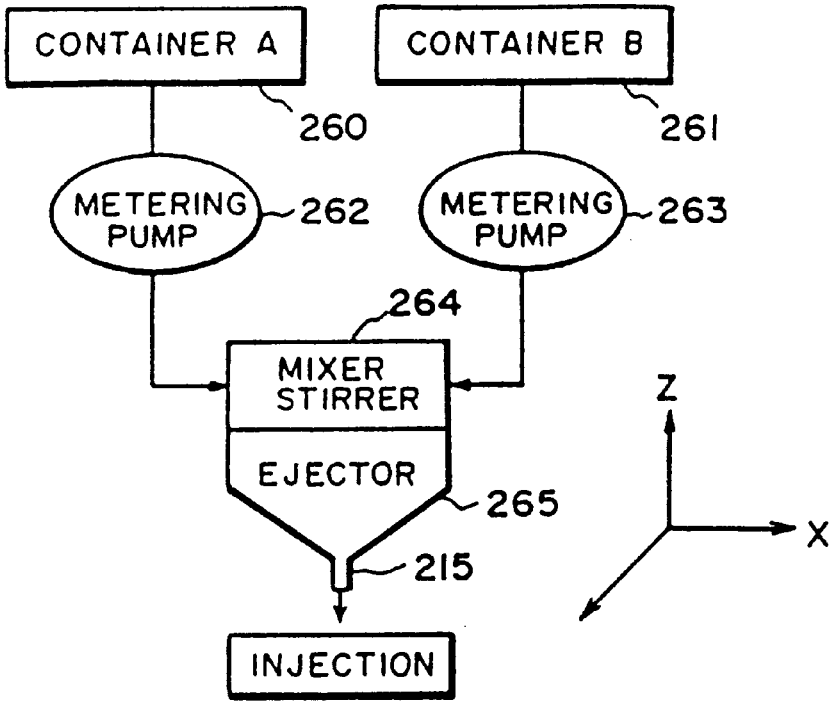
FIG. 15 schematically illustrates an injection system for the liquid elastomer.

In this embodiment, the liquid elastomer is dispensed to the coupling surface. Referring to FIG. 15, the description will be made as to the system for mixing the two-liquid-active material (liquid elastomer) and ejecting it through a nozzle 215.

In FIG. 15, liquid A and liquid B are contained in containers A60 and B61. They are metered by precise metering pumps 262 and 263 to a mixing and stirring station 264 so that the mixture ratio thereof are proper for the two-liquid reaction. In the mixing and stirring station 264, the liquid A and liquid B are uniformly mixed by the motor. It requires at least 30 sec approximately for the mixed liquid to solidify into an elastic elastomer, and therefore, the mixed liquid is ejected through a nozzle 215 of the ejector 265 in the middle of the reaction. The mixing and stirring station 264, the ejector 265 and an injection head including a nozzle 215 are moved along X-, Y-, and Z-axes to meet the configuration of the containers or the like, while the liquid elastomer is being ejected.

The metering by the metering pumps 262 and 263, the mixing and stirring speeds, movement of the ejecting head along the three axes, the ejecting speed or the like, are properly controlled in accordance with a program set in a controller of an unshown industrial robot. Therefore, the injecting operation is carried out automatically.

The materials used are as follows.

TABLE 1

| | Liquid A | Liquid B | Foaming Rate (Vol.) | Solidified Elastomer |
|---|---|---|---|---|
| Ex. 1 | Polyol | Isocyanate | 2–5 | Foaming Polyurethane (ISOACK Corporation) |
| | Mix. ratio: 10:2–3 | | | |
| Ex. 2 | (—OH) Silicone | (—H) Silicone | 2–10 | Foaming Silicone (TORAY SILICONE) |
| | Mix. ratio: 1:1 | | | |

Figure 16:
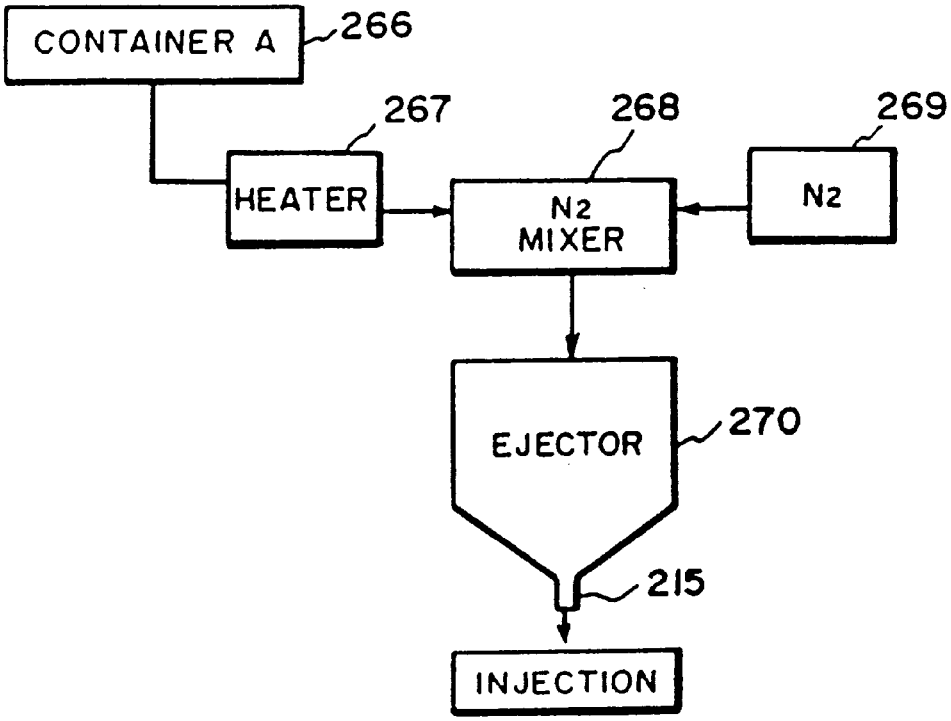
FIG. 16 is a schematic view of a liquid elastomer injection system.
Figure 17:
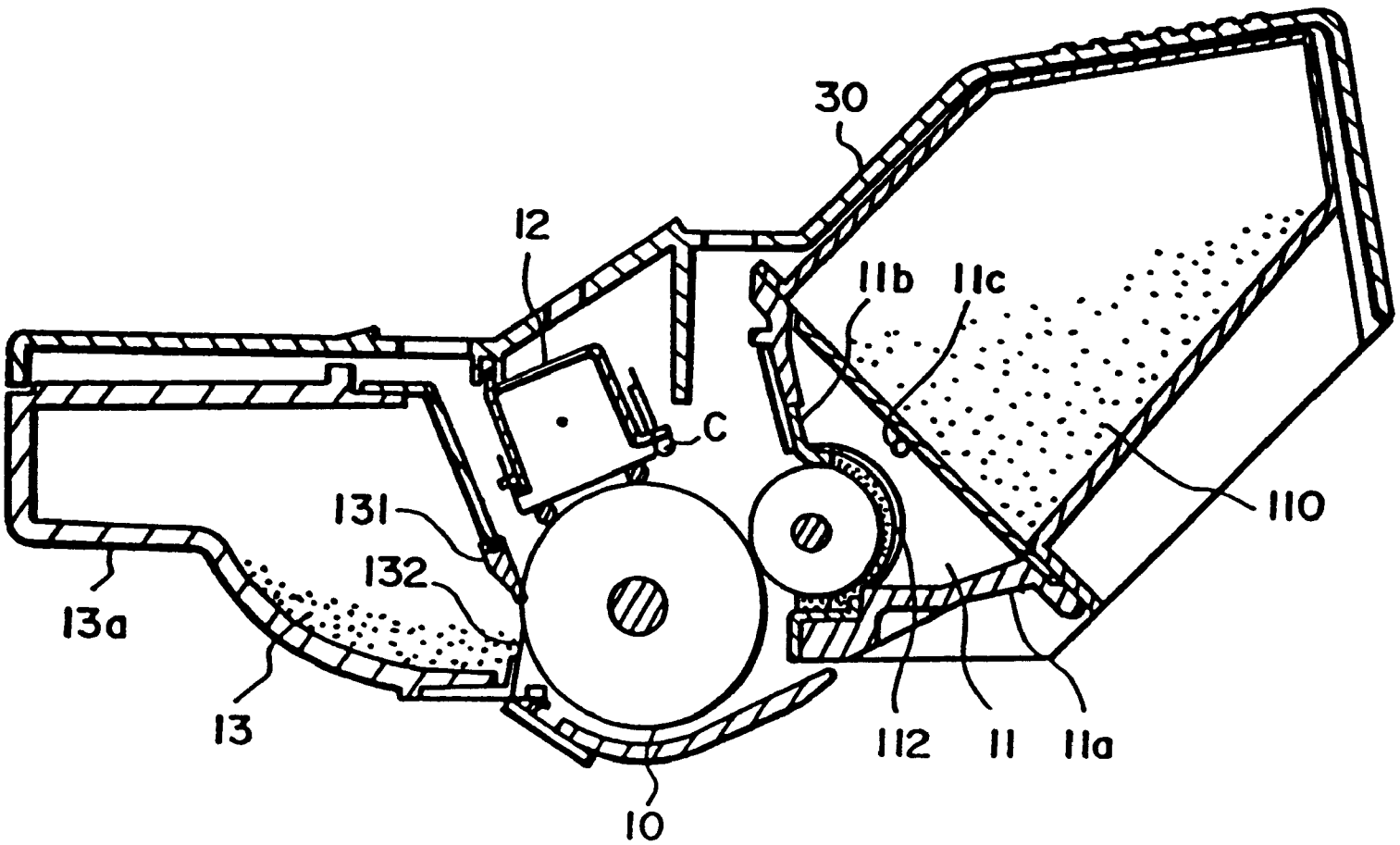
FIG. 17 PRIOR ART
FIG. 17 is a sectional view of a conventional process cartridge.

Referring to FIG. 16, the description will be made as to a system in which single-liquid reaction type liquid is used. A $N_2$ gas is injected into the liquid to foam it, and it is ejected through a nozzle 16.

In FIG. 16, a liquid elastomer mainly comprising polyurethane material is heated by a heater to 70° C.–100° C. in a container 266. It is supplied by a pump to a foam mixing machine 268. In the foam mixing machine 268, the liquid supplied from the container 266 is mixed with $N_2$ gas so as to be foamed. Before the liquid elastomer is solidified, it is ejected to the member such as the toner container or the like through the nozzle 215 of the ejection 270.

Similarly to the case of the two-liquid type material, an unshown industrial robot is used, so that the controller thereof properly controls the mixture of the $N_2$ gas, the supply of the material, the movement in the three axes directions of the injecting head and the injection speed or the like. Therefore, the injecting or dispensing operations are automatic.

The elastomer in this embodiment preferably has an elongation of 100–200%, a hardness (Asker C) hardness of 4–15, a compression-restoration of not less than 90%.

In the foregoing, the description has been made as to the case of the process cartridge having both a the residual toner container for the cleaning means and a toner container for the developing means. The present invention is not limited to this, and the present invention is applicable to a process cartridge having at least one of these containers.

As described in the foregoing, according to the embodiments of the present invention, the sealing member is constituted by solidifying the dispensed liquid elastomers for the plural connecting portions of the process cartridge developer container, and therefore, the leakage of the developer can be prevented more positively than conventional devices, and in addition, the present invention is advantageous in that the sealing can meet complicated connecting portions.

In addition, automatic control for the liquid elastomer injection is possible, and therefore, the assembling operation of the process cartridge is made easier.

The process cartridge described in the foregoing may contain an image bearing member and at least one process means actable directly or indirectly on the image bearing member. More particularly, the process cartridge may contain as a unit an electrophotographic photosensitive member and a charging means, developing means and/or cleaning means. The cartridge thus constituted is detachably mountable to an image forming apparatus such as a copying machine or a laser beam printer.

As described in the foregoing, according to the embodiments of the present invention, the process cartridge is divisible into frames, one of which contains an image bearing member and process means actable thereon, and the other of which contains a toner container having toner particles and/or residual toner container. They are assembled by putting them together, and thereafter, they may be disassembled.

Therefore, the present invention provides the following advantageous effects:

1. By selecting the frame containing the toner container (developer container), process cartridges having different service life and cross-sections can be easily produced:

2. The frame containing the image bearing member and the process means can be made the same so that the manufacturing management is made simpler; and 3. The process cartridge can be reused by collecting the used process cartridge (empty toner container), disassembling the frames, replacing worn parts and coupling the toner container refilled with the fresh toner.

According to the present invention, a process cartridge having the feature of easy assembling and an image forming apparatus usable therewith, can be provided.

While the invention has been described with reference to the structures disclosed herein, it is not confined to the details set forth and this application is intended to cover such modifications or changes as may come within the purposes of the improvements or the scope of the following claims.

What is claimed is:

1. A method for refilling a used process cartridge with toner, the process cartridge being detachably mountable to a main assembly of an electrophotographic image forming apparatus, and including (i) a first frame containing a photosensitive drum, a developing roller for developing an electrostatic latent image formed on said photosensitive drum and a cleaning blade and (ii) a second frame, separable from the first frame, and having a developer accommodating portion for accommodating developer to be used by the developing roller for a developer operation, a developer supply opening for permitting flow of developer from the developer accommodating portion to the developing roller, and an exposure opening for exposing the photosensitive drum to image light emitted from the main assembly of said image forming apparatus, the method comprising the steps of:

separating the first and second frames from each other, so that when the first and second frames are separated, the developer supply opening is substantially entirely exposed;

supplying developer into the developer accommodating portion;

sealing the developer supply opening with a sealing member, the sealing member being removable from the second frame before mounting of the process cartridge to the main assembly of the image forming apparatus, to permit supply of developer to the developing roller; and coupling the first frame and second frame with each other.

2. A method according to claim 1, wherein the step of supplying developer into the accommodating portion comprises the steps of removing a toner cap from a toner filling opening of the developer accommodating portion, filling developer through the toner filling opening, and then reinserting the toner cap in the toner filling opening.

3. A method according to claim 1, further comprising the step of cleaning the first and second frames after said separating step.

4. A method according to claim 2, further comprising the step of cleaning the first and second frames after said separating step.

5. A method according to claim 1, further comprising the step of replacing a used part of the cartridge prior to said coupling step.

6. A method according to claim 2, further comprising the step of replacing a used part of the cartridge prior to said coupling step.

7. A method according to claim 3, further comprising the step of replacing a used part of the cartridge prior to said coupling step.

8. A method according to claim 4, further comprising the step of replacing a used part of the cartridge prior to said coupling step.

9. A method according to any one of claims 1 to 8, and further comprising the step of releasably coupling the first frame and the second frame by releasably engaging a resilient hook formed on one of the first and second frames and an opening formed in the other one of the first and second frames.

10. A method according to claim 9, wherein the opening is formed in the first frame, and the hook is formed in the second frame.

11. A method according to claim 1, further comprising the step of releasably coupling the first frame and the second frame with a screw.

12. A method according to claim 1, wherein said sealing step is performed prior to said developer supplying step.

13. A method for refilling a used process cartridge with toner, the process cartridge being detachably mountable to a main assembly of an electrophotographic image forming apparatus, including (i) a first frame containing a photosensitive drum, a developing roller for developing an electrostatic latent image formed on said photosensitive drum, and a cleaning blade for removing residual toner remaining on said photosensitive drum, and (ii) a second frame, separable from the first frame, and having a developer accommodating portion for accommodating developer to be used by the developing roller for a developing operation, a developer supply opening for permitting flow of developer from the developer accommodating portion to the developing roller, and an exposure opening for exposing the photosensitive drum to image light emitted from the main assembly of the image forming apparatus, the method comprising the steps of:

separating the first and second frames from each other, so that when the first and second frames are separated the developer supply opening is substantially entirely exposed;

sealing the developer supply opening with a sealing member, the sealing member being removable from the second frame before mounting of the process cartridge to the main assembly of the image forming apparatus, to permit supply of developer to said developing roller;

removing a toner cap from a toner filling opening formed in the developer accommodating portion;

filling developer into the developer accommodating portion through the toner filling opening;

capping the toner filling opening with a toner cap; and coupling the first frame and second frames with each other.

14. A method according to claim 13, further comprising the step of cleaning the first and second frames after said separating step.

15. A method according to claim 14, further comprising the step of replacing a used part of the cartridge prior to said coupling step.

16. A method according to claim 13, further comprising the step of replacing a used part of the cartridge prior to said coupling step.

17. A method according to any one of claim 13 to 15, further comprising the step of releasably coupling the first frame and the second frame by releasably engaging a resilient hook formed on one of the first and second frames and an opening formed in the other one of the first and second frames.

18. A method according to claim 17, wherein the opening is formed in the first frame, and the hook is formed on the second frame.

19. A method for refilling a used process cartridge with toner, the process cartridge being detachably mountable to a main assembly of an electrophotographic image forming apparatus, and including (i) a first frame containing a photosensitive drum, a developing roller for developing an electrostatic latent image formed on said photosensitive drum, a cleaning blade for removing residual toner remaining on said photosensitive drum, and a coupling aperture, (ii) a second frame, separable from the first frame, and having a developer accommodating portion for accommodating developer to be used by the developer roller for a developing operation, a developer supply opening for permitting flow of developer from the developer accommodating portion to the developing roller, an exposure opening for exposing the photosensitive drum to image light emitted from the main assembly of the image forming apparatus, and a hook engageable with the coupling aperture; and (iii) a charging roller for charging the photosensitive drum, the method comprising the steps of:

separating the first and second frames from each other, including disengaging the hook from the coupling aperture, such that, when the first and second frames are separated, the developer supply opening is substantially entirely exposed;

sealing the developer supply opening with a sealing member, the sealing member being removable from the second frame before mounting the process cartridge to the main assembly of the image forming apparatus, to permit supply of developer to the developing roller;

removing a toner cap from a toner filling opening formed in the developer accommodating portion;

filling developer into the developer accommodating portion through the toner filling opening;

capping the toner filling opening with the toner cap; and coupling the first frame and second frame with each other, the coupling step including engaging the hook with the coupling aperture.

20. A method according to claim 19, wherein said separating step includes unthreading a screw fastening the first frame and the second frame.

21. A method according to claim 20, wherein said coupling step includes fastening said first and second frames with each other by a screw.

22. A method according to claim 20, further comprising the step of cleaning the frames after said separating step.

23. A method according to claim 19, wherein said coupling step includes fastening said first and second frames with each other by a screw.

24. A method according to claim 19, further comprising the step of cleaning the frames after said separating step.

25. A method according to any one of claims 19 to 24, further comprising the step of replacing a used part of the cartridge prior to said coupling step.

26. A method for refilling a used process cartridge with toner, the process cartridge being detachably mountable to a main assembly of an electrophotographic image forming apparatus, and including (i) a first frame containing a photosensitive drum, a developing roller for developing an electrostatic latent image formed on said photosensitive drum. and (ii) a second frame, separable from the first frame, and having a developer accommodating portion for accommodating developer to be used by the developer roller for a developing operation, a developer supply opening for permitting flow of developer from the developer accommodating portion to the developing roller, the method comprising the steps of:

separating the first and second frames from each other;

supplying developer into the developer accommodating portion, wherein the step of supplying developer into the accommodating portion comprises the steps of removing a toner cap from a toner filling opening of the developer accommodating portion, filling developer through the toner filling opening, and then reinserting the toner cap in the toner filling opening;

sealing the developer supply opening with a sealing member, the sealing member being removable before mounting of the process cartridge to the main assembly of the image forming apparatus, to permit supply of developer to the developer roller; and releasably coupling the first frame and the second frame by releasably engaging a resilient hook formed on the second frame and an opening formed in the first frame.

27. A method according to claim 26, further comprising the step of releasably coupling the first frame and the second frame with a screw.

28. A method according to claim 26, wherein said sealing step is performed prior to said developer supplying step.

29. A method for refilling a used process cartridge with toner, the process cartridge being detachably mountable to a main assembly of an electrophotographic image forming apparatus, and including (i) a first frame containing a photosensitive drum, a developing roller for developing an electrostatic latent image formed on said photosensitive drum, and (ii) a second frame, separable from the first frame, and having a developer accommodating portion for accommodating developer to be used by the developer roller for a developing operation, a developer supply opening for permitting flow of developer from the developer accommodating portion to the developing roller, the method comprising the steps of:

separating the first and second frames from each other;

supplying developer into the developer accommodating portion;

cleaning the first and second frames;

sealing the developer supply opening with a sealing member, the sealing member being removable before mounting of the process cartridge to the main assembly of the image forming apparatus. to permit supply of developer to the developer roller; and releasably coupling the first frame and the second frame by releasably engaging a resilient hook formed on the second frame and an opening formed in the first frame.

30. A method for refilling a used process cartridge with toner, the process cartridge being detachably mountable to a main assembly of an electrophotographic image forming apparatus, and including (i) a first frame containing a photosensitive drum, a developing roller for developing an electrostatic latent image formed on said photosensitive drum, and (ii) a second frame, separable from the first frame, and having a developer accommodating portion for accommodating developer to be used by the developer roller for a developing operation, a developer supply opening for permitting flow of developer from the developer accommodating portion to the developing roller, the method comprising the steps of:

separating the first and second frames from each other;

supplying developer into the developer accommodating portion;

sealing the developer supply opening with a sealing member, the sealing member being removable before mounting of the process cartridge to the main assembly of the image forming apparatus, to permit supply of developer to the developer roller;

replacing a used part of the cartridge; and releasably coupling the first frame and the second frame by releasably engaging a resilient hook formed on the second frame and an opening formed in the first frame.

* * * * *

UNITED STATES PATENT AND TRADEMARK OFFICE

CERTIFICATE OF CORRECTION

PATENT NO.: 5,987,278

DATED : November 16, 1999

INVENTOR(S) : Yoshiya NOMURA et al.

It is certified that error appears in the above-identified patent and that said Letters Patent is hereby corrected as shown below:

ON THE COVER PAGE:

At [56], References Cited, U.S. PATENT DOCUMENTS, insert
--4,615,608 10/1986 Mizutani.....399/103--.

At [56], References Cited, FOREIGN PATENT DOCUMENTS,
change "0368346 5/1989" to --0368346 5/1990--.
change "0330225 8/1990" to --0330225 8/1989--.

COLUMN 1:

Line 5, "Ser. No." should read --Ser. No. 08/770,687, filed Dec. 17, 1996, now abandoned, which is a continuation of application Ser. No.--.
Line 8, "of" should read --of application Ser. No.--.
Line 45, "are" should read --is--.

COLUMN 6:

Line 1, "1102," should read --110a,--.

COLUMN 8:

Line 65, "injection" should read --injecting--.

UNITED STATES PATENT AND TRADEMARK OFFICE

CERTIFICATE OF CORRECTION

PATENT NO. : 5,987,278

DATED : November 16, 1999

INVENTOR(S) : Yoshiya NOMURA et al.

It is certified that error appears in the above-identified patent and that said Letters Patent is hereby corrected as shown below:

COLUMN 9:

Line 53, "dispense." should read --dispensing.--.
Line 55, "return" should read --return to--.

COLUMN 10:

Line 24, "are" should read --is--.

COLUMN 13:

Line 41, "15," should read --16,--.

Signed and Sealed this

Twenty-sixth Day of December, 2000

*Attest:*

Q. TODD DICKINSON

*Attesting Officer*

*Director of Patents and Trademarks*